US011864598B2

(12) United States Patent
Greenwood et al.

(10) Patent No.: US 11,864,598 B2
(45) Date of Patent: Jan. 9, 2024

(54) INSERTABLE BRASSIERE PAD HAVING INTERLOCKABLE DISCS TO PREVENT DISPLACEMENT WITHIN A GARMENT POCKET

(71) Applicants: Taylor Linn Greenwood, Lehi, UT (US); Nathan Reid Greenwood, Lehi, UT (US)

(72) Inventors: Taylor Linn Greenwood, Lehi, UT (US); Nathan Reid Greenwood, Lehi, UT (US)

( * ) Notice: Subject to any disclaimer, the term of this patent is extended or adjusted under 35 U.S.C. 154(b) by 260 days.

(21) Appl. No.: 17/468,785

(22) Filed: Sep. 8, 2021

(65) Prior Publication Data

US 2023/0071873 A1 Mar. 9, 2023

(51) Int. Cl.
*A41C 3/10* (2006.01)
*A41C 3/14* (2006.01)
*A41C 3/00* (2006.01)

(52) U.S. Cl.
CPC ..... *A41C 3/10* (2013.01); *A41C 3/0057* (2013.01); *A41C 3/144* (2013.01)

(58) Field of Classification Search
None
See application file for complete search history.

(56) References Cited

U.S. PATENT DOCUMENTS 3,221,748 A * 12/1965 Glasser ..... A41C 3/10 D2/706
3,255,754 A * 6/1966 Brumberger ..... A41D 7/00 450/55
6,319,092 B1 * 11/2001 Leyhe ..... A41C 3/0071 450/36
7,115,015 B2 * 10/2006 Horii ..... A41D 7/00 450/33
8,562,388 B2 * 10/2013 Izzo ..... A61F 2/52 450/57
8,708,771 B1 * 4/2014 De Rosa ..... A41C 3/10 450/36

(Continued)

FOREIGN PATENT DOCUMENTS

JP 2002302806 A * 10/2002 ..... A41C 3/0092

OTHER PUBLICATIONS

"Patent Translate" machine translation of JP 2002302806 A, provided via Espacenet on Sep. 22, 2023 (Year: 2023).*

*Primary Examiner* — Jocelyn Bravo
(74) *Attorney, Agent, or Firm* — Jeffrey L. Streets

(57) ABSTRACT

An apparatus includes a flexible brassiere pad with first interlockable discs are secured to the flexible brassiere pad, wherein each first interlockable disc has a first interlockable member directed to a first side of the flexible brassiere pad. The apparatus further includes second interlockable discs, each having a second interlockable member that is disconnectably connectable to the first interlockable member of one of the first interlockable discs. Optionally, the apparatus may further include, or be used with, a sports brassiere forming a pair of breast cups, each breast cup forming a pocket between inner and outer fabric layers, wherein the pocket is configured to receive the flexible brassiere pad. Connecting the second interlockable discs to the first interlockable discs from opposite sides of the inner fabric layer secures the flexible brassiere pad in a desired position within the pocket.

23 Claims, 7 Drawing Sheets

(56) References Cited

U.S. PATENT DOCUMENTS

| | | | | |
|---|---|---|---|---|
| 8,840,442 | B2 * | 9/2014 | Linkon | A41C 3/10 450/36 |
| 2008/0176485 | A1 * | 7/2008 | Linkon | A41C 3/10 450/57 |
| 2015/0181949 | A1 * | 7/2015 | Linkon | A41C 3/10 450/57 |
| 2019/0174841 | A1 * | 6/2019 | Bastug | A41C 3/0007 |
| 2019/0350276 | A1 * | 11/2019 | Thompson | A41C 3/144 |
| 2020/0085113 | A1 * | 3/2020 | Rendone | A41C 3/0035 |
| 2021/0007418 | A1 * | 1/2021 | Kim | A41C 3/144 |

* cited by examiner

INSERTABLE BRASSIERE PAD HAVING INTERLOCKABLE DISCS TO PREVENT DISPLACEMENT WITHIN A GARMENT POCKET

BACKGROUND

The present disclosure relates to an insertable brassiere pad, a brassiere and other garments having a pocket for receiving an insertable brassiere pad.

BACKGROUND OF THE RELATED ART

Brassiere pads, also referred to as bra pads or breast pads, are a material used in a brassiere to provide a desired effect. One desired effect of brassiere pads may be to conceal the wearer's nipples, which may otherwise form a visible impression in the brassiere or clothing worn over the brassiere. Another desired effect of the brassiere pads may be to accentuate the appearance of the breasts. For example, brassiere pads may have a contour or thickness that will lift the breasts in the same manner as a push up brassiere. Still further, brassiere pads may provide a desired effect of providing support and comfort for the breasts. Brassiere pads may even provide moisture-wicking away from the skin. These and other possible benefits have led to brassiere pads being a common feature of many brassieres, including sports brassieres that are specifically designed to provide a beneficial amount and type of breast support during physical exercise. Sports brassieres are a garment that are typically made from high-performance fabrics.

BRIEF SUMMARY

Some embodiments provide an apparatus comprising a flexible brassiere pad having a first side and a perimeter edge. The apparatus further comprises a plurality of first interlockable discs secured to the flexible brassiere pad, wherein each of the first interlockable discs has a first interlockable member directed to the first side of the flexible brassiere pad. Still further, the apparatus comprises a plurality of second interlockable discs, wherein each of the second interlockable discs has a second interlockable member that is disconnectably connectable to the first interlockable member of one of the first interlockable discs.

DETAILED DESCRIPTION

Figure 1A:
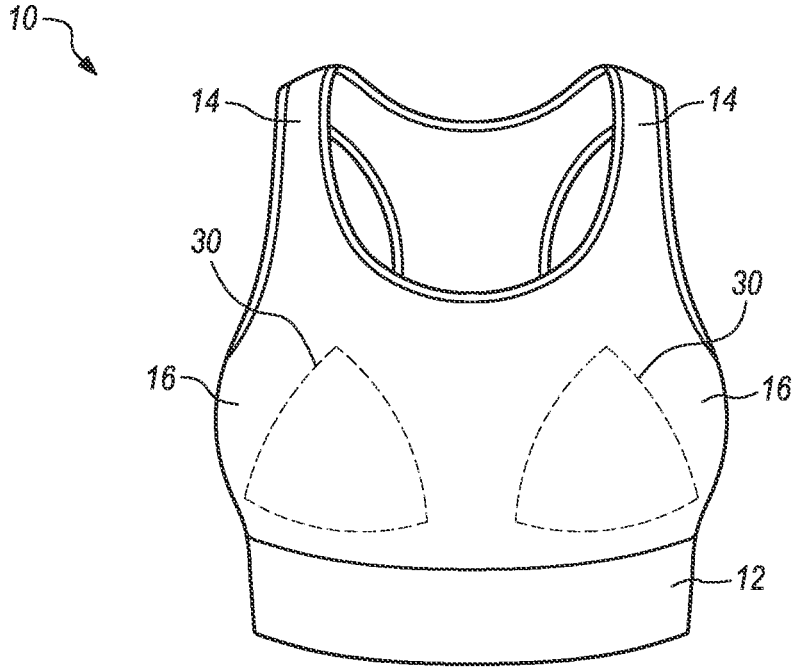
FIGS. 1A-1B are front and back views of a sports brassiere, respectively.

Some embodiments provide an apparatus comprising a flexible brassiere pad having a first side. The apparatus further comprises a plurality of first interlockable discs secured to the flexible brassiere pad, wherein each of the first interlockable discs has a first interlockable member directed to the first side of the flexible brassiere pad. Still further, the apparatus comprises a plurality of second interlockable discs, wherein each of the second interlockable discs has a second interlockable member that is disconnectably connectable to the first interlockable member of one of the first interlockable discs.

Some embodiments of the flexible brassiere pad may be made from various materials, such as a fabric, a compressible polymeric foam pad, and/or silicone. Non-limiting examples of the fabric include nylon, polyether-polyurea copolymer, polyamide, polyester or nylon microfiber, cotton or cotton-like materials. Fabrics made with polyether-polyurea copolymers may have exceptional elasticity are sometimes referred to as spandex, LYCRA (a trademark of The Lycra Company), or elastane. A suitable polymeric foam may be a thermoplastic foam.

Some embodiments of the flexible brassiere pad may be either flat or cup-shaped with an inner surface having contour that may be similar to a portion of a breast. For example, the flexible brassier pad may have a surface that is concave to fit over or receive a portion of a breast. Furthermore, the flexible brassier pad may have various shapes, such as triangular, rounded triangular, round and oval shapes. The thickness of the flexible brassiere pad may be thin, thick and variable thickness. The dimensions of the flexible brassiere pad may also vary, but should fit within a pocket of a brassiere, such as a sports brassiere, with the first side of the flexible brassiere pad directed against the inner fabric layer.

In some embodiments, a first interlockable disc and a second interlockable disc form a fastener commonly referred to as a snap or snap fastener. A snap may be described as having two main components that are disconnectably connectable to each other with a manual force. The two main components of a snap may be referred to as a stud and a socket. In one option, each of the first interlockable discs may include a stud and each of the second interlockable discs may include a socket. In another option, each of the first interlockable discs may include a socket and each of the second interlockable discs may include a stud. Still further, the first plurality of interlockable discs may include some combination of studs and sockets, and the second plurality of interlockable discs may include a complementary set of sockets and studs, wherein the complementary set of sockets and studs includes a socket for each of the studs in the first plurality of interlockable discs and stud for each of the sockets in the first plurality of interlockable discs.

In some embodiments, a connection may be formed by pushing the stud into the socket, such that the stud will remain secured within the socket unless and until there is a sufficient force to withdraw the stud from the socket. In various embodiments, the stud may be retained by friction and/or flexing of the stud and socket, or by a wire spring that forms part of the socket. Both the stud and the socket may be secured to another material, such as the flexible brassiere pad and/or the inner fabric layer of a sports brassiere, using any available manner of connection. Non-limiting examples of connections include sewing, prongs and posts. In one option, each first interlockable disc includes a first backing member having a post that extends through a first material or fabric to engage and secure to a second member that includes the first interlockable member, and each second interlockable disc includes a first member having a post that extends through a second material or fabric piece to engage and secure to a second member that includes the second interlockable member. In another option, each first interlockable disc includes a first backing member having a set of prongs that extend through the first material or fabric to engage and secure to a second member that includes the first interlockable member, and each second interlockable disc includes a first backing member having a set of prongs that extend through the second material or fabric piece to engage and secure to a second member that includes the second interlockable member. Optionally, any of the interlockable members may be made from a metal or a plastic.

In some embodiments, a first interlockable disc and a second interlockable disc form a fastener commonly referred to as a magnetic snap or fastener. A magnetic snap may be described as having two main components that are disconnectably connectable to each other via a magnetic force. The two main components of the magnetic snap may both be magnets, or one component may be a magnet and the other component may be a ferrous metal. Since the magnetic snap forms a connection using magnetic attraction, the magnetic snap does not rely upon friction or spring forces to secure the discs together. In fact, a magnetic snap may have first and second interlockable discs that have flat and/or smooth surfaces at an interface therebetween. However, some magnetic snaps may still include a stud and a socket for the purpose of alignment with each other and/or to increase a grip on the inner fabric layer. In one option, each of the first interlockable discs may include a magnetic disc with a stud and each of the second interlockable discs may include a ferrous metal socket. In another option, each of the first interlockable discs may include a magnetic disc with a socket and each of the second interlockable discs may include a ferrous metal stud. Still further, the first plurality of interlockable discs may include some combination of magnetic and ferrous metal discs, and the second plurality of interlockable discs may include a complementary set of magnetic and ferrous metal discs. A magnetic connection may be formed by positioning a first interlockable disc in close proximity to a second interlockable disc until the magnetic attraction pulls the first and second interlockable discs together to complete the connection. The magnetic connection between the first and second interlockable discs will remain connected unless and until there is a sufficient force to overcome the magnetic attraction. Furthermore, if the magnetic connection is formed between first and second interlockable discs that include a stud and a socket, then stud and socket may prevent purely lateral forces from dislodging the discs and overcoming the magnetic attraction. Accordingly, in the case of a magnetic connection between a pair of discs having a stud and a socket, then force required to overcome the magnetic attraction must be at least partially directed in an axial direction defined by the stud and socket. Since the sports brassiere or other garment may keep the magnetic connection in compression against the wearer's skin, the magnetic connection is unlikely to become accidentally disconnected. The two components or sides of a magnetic snap (i.e., the first and second interlockable discs) may themselves be secured to another material, such as the flexible brassiere pad, the fabric piece and/or the inner fabric layer, using any available manner of connection. Non-limiting examples of connections include sewing, prongs and posts as described in greater detail in reference to a mechanical snap or interlocking discs.

In some embodiments, the flexible brassiere pad has a perimeter edge, and the plurality of first interlockable discs are secured to the flexible brassiere pad near the perimeter edge of the flexible brassier pad. Without limitation, a first interlockable disc that is "near" or "adjacent" the perimeter edge of the flexible brassier pad may be within about 2 inches of the perimeter edge, within about 1 inch of the perimeter edge, or within about 0.5 inch of the perimeter edge. Positioning the first interlockable discs near the perimeter edge of the flexible brassiere pad provide the advantage of keeping the flexible brassiere pad spread out, such that the pad, or a perimeter edge of the pad, does not become folded or wadded up.

In one specific embodiment, a perimeter edge of the flexible brassiere pad forms a rounded triangular shape having three vertices. Optionally, the plurality of first interlockable discs may include three of the first interlockable discs secured to the flexible brassiere pad near the perimeter edge of the flexible brassiere pad, wherein, for each of the first interlockable discs, the interlockable disc is positioned proximate a separate one of the vertices.

Some embodiments of the apparatus may be used with a sport brassiere, regular brassiere, swimsuit, bikini top, shirts, dresses or any other type of garment having a pocket formed in the area of a breast cup for the purpose of receiving a flexible brassiere pad. The embodiments and descriptions herein may refer to a sports brassiere, but such reference to a sports brassiere is a representative example of all types of garments that may have a pocket for receiving a flexible brassiere pad and the reference should be understood to be equally applicable to many other types of garments that may similarly include a breast cup pocket for receiving a flexible brassier pad. In one example, the apparatus may form a kit that includes the flexible brassiere pad with a plurality of the first interlockable discs secured near the perimeter edge of the flexible brassiere pad, wherein each of the first interlockable discs have a first interlockable member directed to a first side of the flexible brassiere pad. The kit may further include a plurality of second interlockable discs, wherein each of the second interlockable discs has a second interlockable member that is disconnectably connectable to the first interlockable member of one of the first interlockable discs. A person may use the kit in combination with any sports brassiere or any other type of garment in order to secure the flexible brassiere pad in a desired position. Specifically, the flexible brassiere pad provided in the kit may be inserted into a pocket of the sports brassiere or other type of garment and positioned so that the first interlockable members are directed against the inner fabric layer of the pocket. Then, with the flexible brassier pad in the desired position, each of the second interlockable discs provided in the kit may be independently axially aligned and connected with one of the first interlockable discs by pressing the first and second interlockable members together with an interlockable force. The inner fabric lies between the first and second interlockable discs and is secured by the connection formed between the first and second interlockable members. A preferred kit may include a pair of the flexible brassiere pads and at least as many second interlockable discs as there are first interlockable discs secured to the pair of flexible brassiere pads.

Some embodiments of the apparatus may include the sports brassiere, regular brassiere, swimsuit, bikini top, shirts, dresses or any other type of garment. For example, the apparatus may include the sports brassier, at least a pair of the flexible brassiere pads with first interlockable discs, and a set of second interlockable discs to connect with the first interlockable discs. The sports brassiere may form a pair of breast cups, where each breast cup forms a pocket between an outer fabric layer and an inner fabric layer, and where each pocket is configured to receive one of the flexible brassiere pads. Unless covered by another layer of clothing, the outer fabric layer of the sports brassiere may be outwardly viewed when the sport brassiere is being worn by a person. The inner fabric layer is directed inward toward the person wearing the sports brassiere and may lay directly against the skin of the breast. Embodiments of the apparatus that includes the sports brassier along with the flexible brassier pads with first interlockable discs and second interlockable discs may include any aspect of the kits and/or sports brassieres described herein as being separately provided.

In some embodiments, each of the plurality of second interlockable discs may be disconnectably connected to one of the first interlockable discs with the inner fabric layer disposed between the first interlockable disc and the second interlockable disc. In one option, each of the second interlockable discs may have a first side that includes a second interlockable member and a second side that is covered with a fabric or foam material. Alternatively, the second side may have a smooth surface regardless of whether the exposed surface is metal, plastic, fabric, foam or other material. During use, the first side of the second interlockable disc may be outwardly directed for forming a connection with a first interlockable disc and the second side of the second interlockable disc may be inwardly directed, such that the second side may be in contact with the skin of a person when the sports brassiere is being worn.

In some embodiments, the flexible brassiere pad may be held in a fixed position within the pocket by the connections formed between the plurality of first interlockable discs and the plurality of second interlockable discs. For example, when inner fabric layer of the pocket is captured between the stud and socket of the interlockable discs, friction between the interlockable discs and the fabric prevents the flexible brassiere pad from moving around within the pocket relative to the inner fabric layer. Furthermore, each connection between a first interlockable disc and a second interlockable disc may remain connected in the absence of a user manually disconnecting the second interlockable disc. In other words, the flexible brassiere pad may be secured in a desired position within the pocket of the sports brassiere prior to use and the flexible brassiere pad will remain in that position while the sports brassiere is being worn. Then, after taking off the sports brassiere, the second interlockable discs may be manually disconnected from the first interlockable discs and the flexible brassiere pad may then be removed from the pocket, such as for washing and drying. Alternatively, the flexible brassiere pads may be kept in place during washing and drying by the connection between the first and second interlockable discs. Securing the flexible brassiere pads to the inner fabric layer with the connections formed the first and second interlockable discs will prevent the flexible brassiere pads from becoming displaced when wearing, washing and/or drying the sports brassiere. Accordingly, the flexible brassiere pads will not move around within the pocket of the sports brassiere, will not become wadded or folded during washing or drying, and will not be otherwise displaced or lost.

In some embodiments, each of the first interlockable discs may include a backing member having a set of prongs that extend through the flexible brassiere pad to engage and secure to a second member that forms the first interlockable member. Similar, each of the second interlockable discs may also include a backing member having a set of prongs that extend through a first fabric piece to engage and secure to a second member that forms the second interlockable member. In some options, the backing members form circular rings or plates from which the set of prongs extend. The set of prongs are directed toward the flexible brassiere pad or fabric piece, and the backing member is then pressed toward the second member such that the prongs pierce through the flexible brassiere pad or fabric piece before engaging and bending into the second member to form a secure connection. The backing member and second member may be aligned and pressed together to form the secure connection using a pair of pliers, such as specialized snap fastener pliers. In embodiments where the backing member includes a post instead of prongs, a punch tool may be used to splay the post to form a riveted connection.

In some embodiments, the second interlockable disc has a soft and/or smooth second side surface opposite of the second interlockable member, such that the soft and/or smooth surface is directed toward the user during use and may be gentle on the skin. In one option, the first fabric piece may wrap around a second side of the second interlockable disc. For example, a second fabric piece may cover the second side of the second interlockable disc and may be secured to the first fabric piece, such as by sewing or adhering. More specifically, the second fabric piece may be secured to the first fabric piece by a thread stitching together the perimeter edge of the first and second fabric pieces. Alternatively, the surface of the second side may be an exposed metal or plastic surface that has no sharp edges.

In some embodiments, the flexible brassiere pads may be any size, color or pattern, thickness or breast support level. Optionally, the back of the second interlockable disc may be a metal, plastic, foam or fabric having a size, color or pattern that matches or coordinates with the color, pattern or material of the flexible brassiere pads. Furthermore, the interlockable discs may be made of metal or plastic, and any number of interlockable discs may be used to secure the flexible brassiere pads into the pockets. The flexible brassier pads may be used in conjunction with sports brassieres having a wide variety of styles and features, such as various strap types and varying degrees of encapsulation and compression. Still further, the sports brassiere may be pulled over the wearer's head or have a closure, such as a hook, clasp or zipper, in the front or back.

Figure 1B:
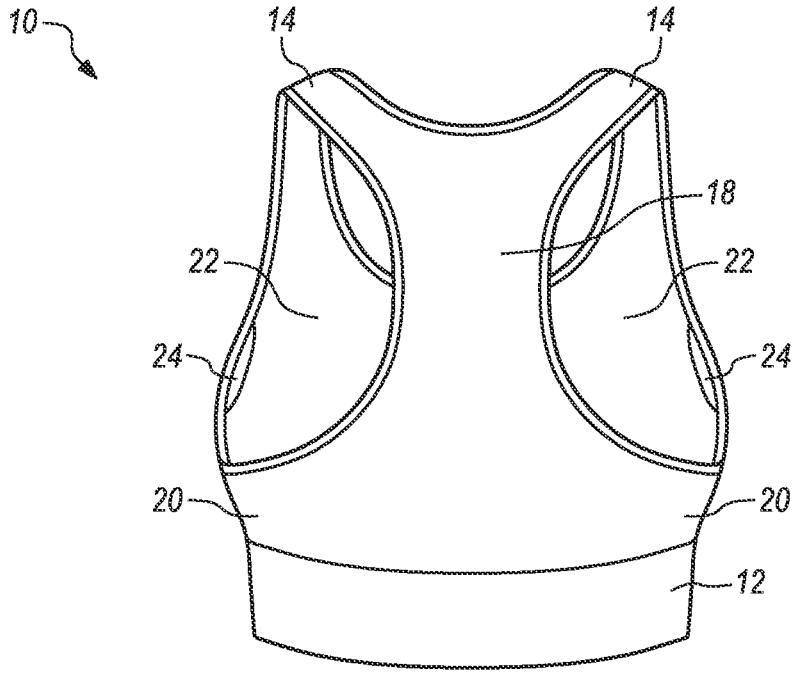

FIGS. 1A-1B are front and back views of a sports brassiere 10, respectively. FIG. 1A shows the sports brassiere 10 having a band 12, a pair of straps 14, and a pair of cups 16 that support and stabilize a wearer's breasts. Although not visible from the front of the sports brassiere 10, the position of a pair of flexible brassiere pads 30 is illustrated using dashed lines. The illustrated pair of flexible brassiere pads 30 have a rounded triangular shape, but other shapes may be used. Various embodiments of the flexible brassiere pads 30 are detailed below in reference to other Figures.

In FIG. 1B, the back view of the sports brassiere 10 shows the back portions of the straps 14 and band 12, as well as a back panel 18 and a pair of side wings 20. The illustrated sports brassiere 10 is a pull-over garment with no closures. In this back view, a portion of an inner fabric layer 22 can be seen in the area of the cups 16 (see FIG. 1A). This inner fabric layer 22 forms a pair of pockets with an outer fabric layer (i.e., the front of the cups 16 shown in FIG. 1A). Each pocket has an opening 24 for inserting and removing the flexible brassiere pads 30 (see FIG. 1A).

Figure 2A:
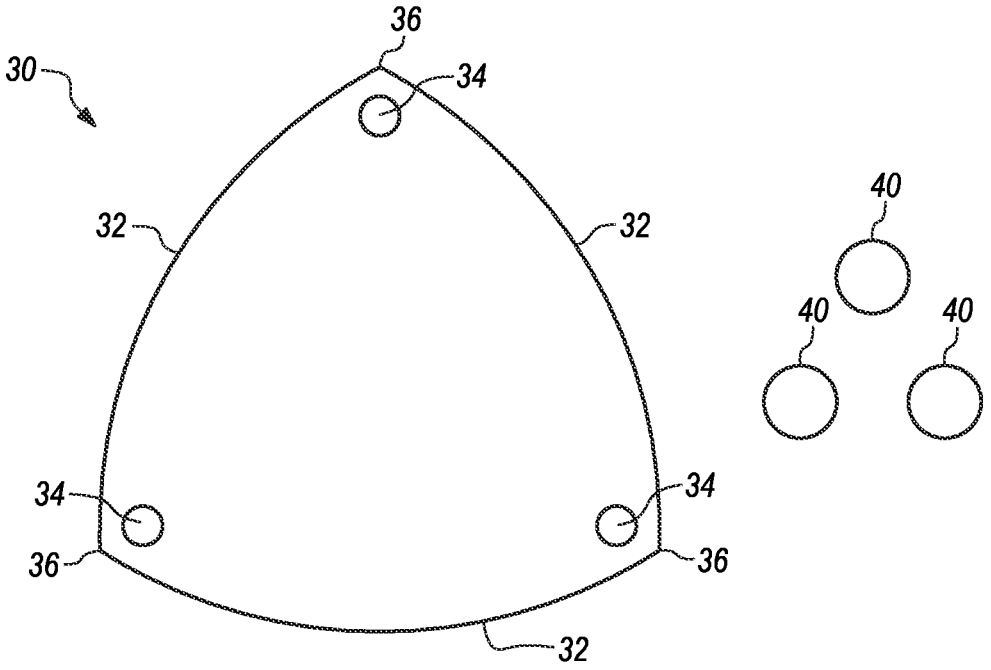
FIGS. 2A-2B are diagrams of flexible brassiere pads having different perimeter shapes.
Figure 2B:
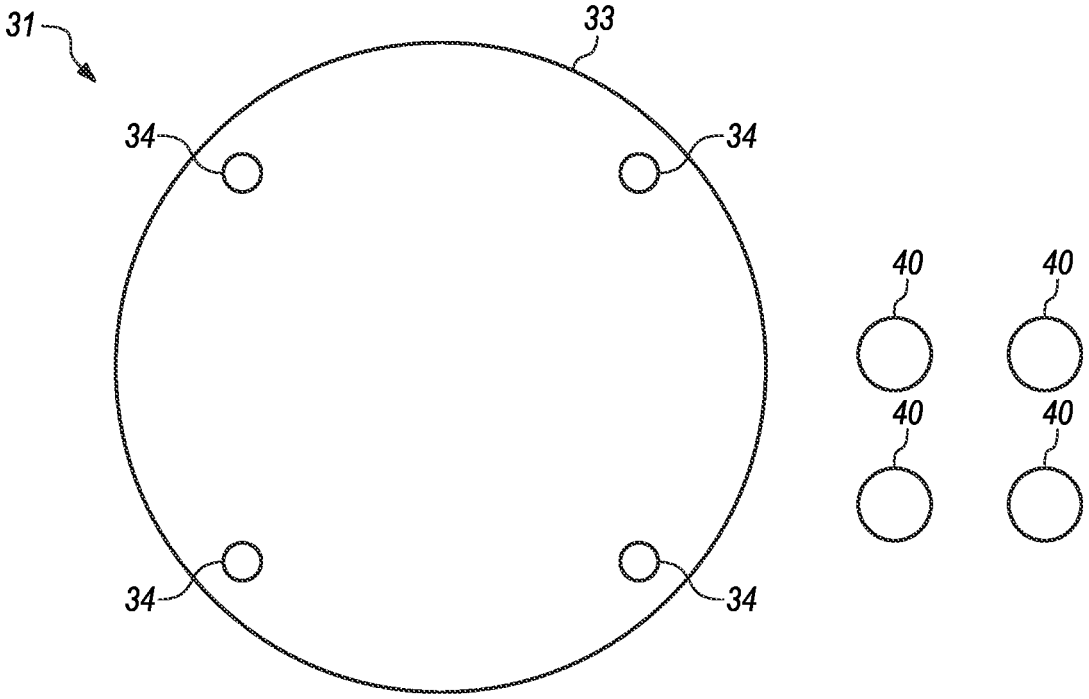

FIGS. 2A-2B are diagrams of the front side of two flexible brassiere pads 30 having different perimeter shapes. FIG. 2A is a diagram of a flexible brassiere pad 30 having a rounded triangular shape, meaning that the three side edges 32 of the triangle are curved rather than straight. Three (first) interlockable discs 34 are secured to the flexible brassiere pad 30 near or adjacent the side edges 32 proximate to, or in alignment with, each of three vertices 36. FIG. 2A also shows a set of three (second) interlockable discs 40 that are each disconnectably connectable to any one of the three (first) interlockable discs 34. Details of the interlockable discs are shown in subsequent Figures.

FIG. 2B is a diagram of a flexible brassiere pad 31 having a circular perimeter shape. In this non-limiting illustration, the flexible brassiere pad 31 has four (first) interlockable discs 34 secured thereto in positions near or adjacent to the perimeter edge 33. The four (first) interlockable discs 34 are preferably nearly equally spaced about the perimeter. As shown, a set of four (second) interlockable discs 40 are shown, such that there is an equal number of the (second) interlockable discs 40 to be disconnectably connectable to any one of the four (first) interlockable discs 34. However, any number of mating first and second interlockable discs may be used with each flexible brassiere pad 30, 31 of FIGS. 2A-2B, or any other flexible brassiere pad shape.

Figure 3A:
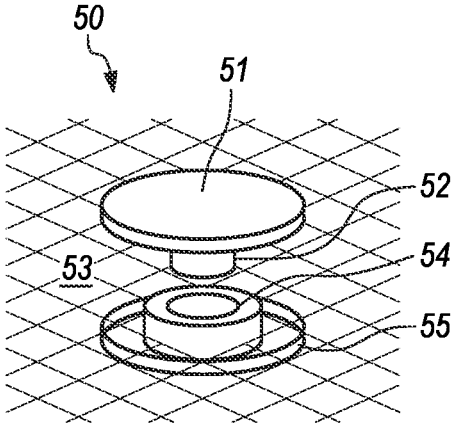
FIGS. 3A-3B are assembly diagrams of a post-type snap socket and stud, respectively.
Figure 3B:
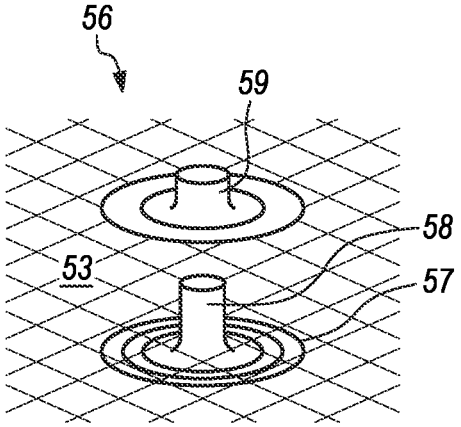

FIGS. 3A-3B are assembly diagrams of a post-type snap socket 50 and post-type snap stud 56, respectively. For example, the post-type snap socket 50 may be a first interlockable disc and the post-type snap stud 56 may be a second interlockable disc that is disconnectably connectable to the first interlockable disc.

In reference to FIG. 3A, a first backing member 51 includes a post 52 that extends through a hole in the material 53 and an opening 54 in a second member 55 that forms one of the interlockable members (i.e., downward facing and not shown in FIG. 3A). With the prong 52 extending through the opening 54, the post 52 may be splayed using a punch tool so that the prong 52 will not pull back through the opening 54 and so that the backing member 51 and the second member 55 are firmly connected with the material 53 held therebetween.

In reference to FIG. 3B, a second backing member 57 includes a post 58 that extends through a hole in the material 53 and a cavity within a second member 59 that forms one of the interlockable members (i.e., the stud). With the post 58 extending into the cavity, the post 58 may be splayed or otherwise deformed so that the post 58 will not pull back out of the cavity in the second member 59 and so that the backing member 57 and the second member 59 are firmly connected with the material 53 held therebetween.

Figure 4A:
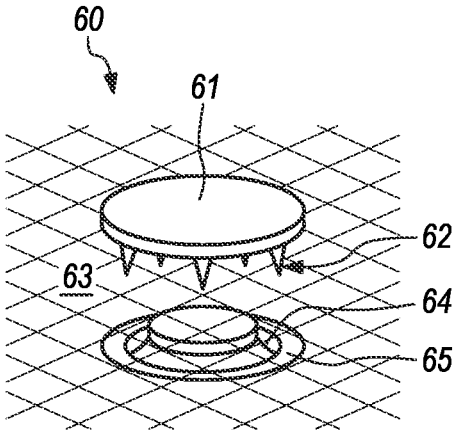
FIGS. 4A-4B are assembly diagrams of a prong-type snap socket and stud, respectively.
Figure 4B:
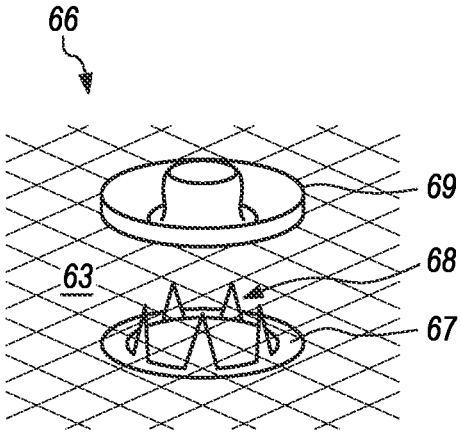

FIGS. 4A-4B are assembly diagrams of a prong-type snap socket 60 and prong-type snap stud 66, respectively. For example, the prong-type snap socket 60 may be a first interlockable disc and the prong-type snap stud 66 may be a second interlockable disc that is disconnectably connectable to the first interlockable disc.

In reference to FIG. 4A, a first backing member 61 includes a set of prongs 62 that pierce through the material 63 and into a channel 64 in a second member 65 that forms one of the interlockable members (i.e., downward facing and not shown in FIG. 3A). With the prongs 62 extending through the material 63, the prongs 62 are driven into the channel 64 and bent so that the prongs 62 will not pull out of the channel 64 and so that the backing member 61 and the second member 65 are firmly connected with the material 63 held therebetween.

In reference to FIG. 4B, a second backing member 67 includes a set of prongs 68 that pierce through the material 63 and into a channel (not shown) in a second member 69 that forms one of the interlockable members (i.e., the stud). With the prongs 68 extending through the material 63, the prongs 68 may be bent so that the prongs 68 will not pull back out of the channel in the second member 69 and so that the backing member 67 and the second member 69 are firmly connected with the material 63 held therebetween.

Figure 5A:
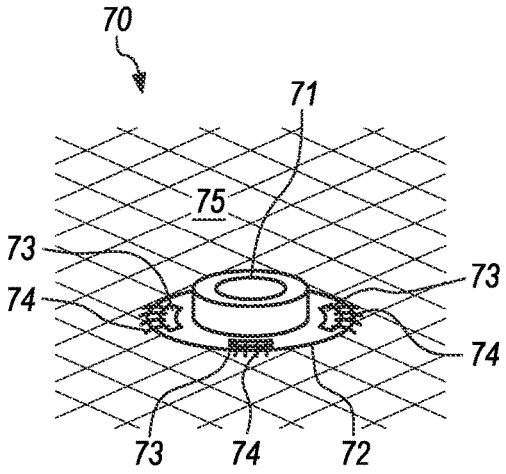
FIGS. 5A-5B are assembly diagrams of a sewn-type snap socket and stud, respectively.
Figure 5B:
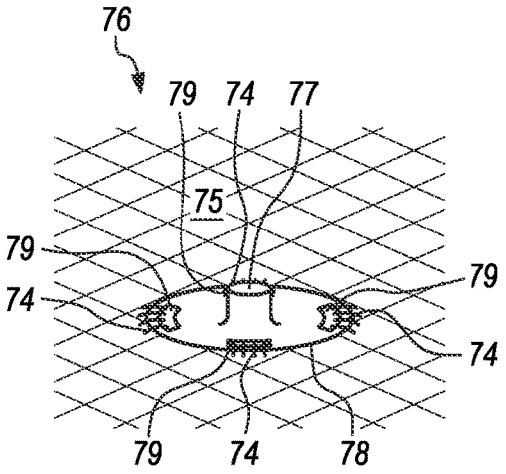

FIGS. 5A-5B are assembly diagrams of a sewn-type snap socket 70 and a sewn-type snap stud 76, respectively. For example, the sewn-type snap socket 70 may be a first interlockable disc and the sewn-type snap stud 76 may be a second interlockable disc that is disconnectably connectable to the first interlockable disc. In reference to FIG. 5A, the sewn-type snap socket 70 has a socket 71 and a ring 72 with a set of holes 73 (three shown; one not shown) along the perimeter. Accordingly, a thread is used to form stitches 74 through the holes 73 and the material 75. In reference to FIG. 5B, the sewn-type snap stud 76 has a stud 77 and a ring 78 with a set of holes 79 (three shown; one not shown) along the perimeter. Accordingly, a thread is used to form stitches 74 through the holes 79 and the material 75.

Figure 6A:
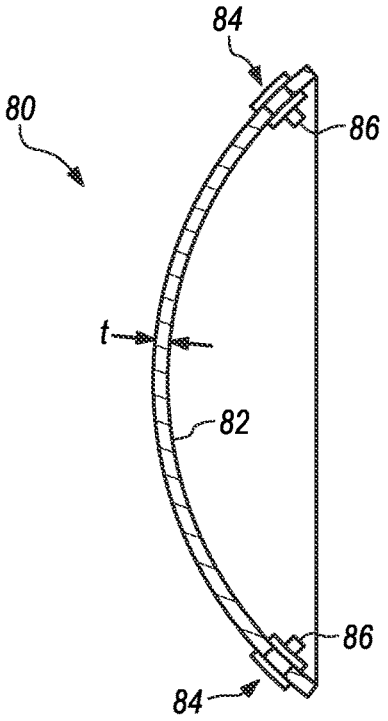
FIGS. 6A-6B are cross-sectional side views of flexible brassiere pads having different thicknesses.
Figure 6B:
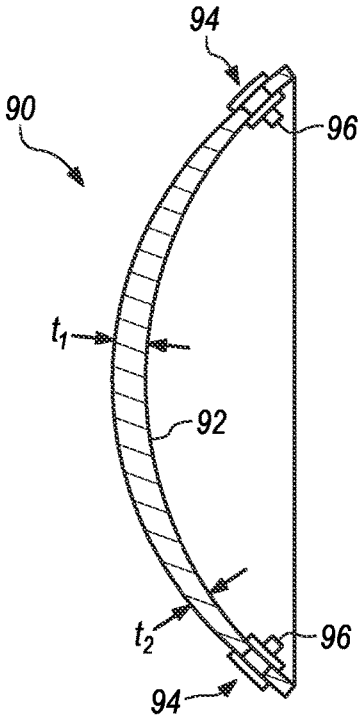

FIGS. 6A-6B are cross-sectional side views of flexible brassiere pads having different thicknesses. In FIG. 6A, a flexible brassiere pad 80 (similar to flexible brassiere pad 30 in FIG. 2A) has a concave or cupped shape with the concave surface (inner surface) 82. The flexible brassiere pad 80 is shown having a fairly uniform thickness (labeled "t") from a top edge to a bottom edge. In addition, the flexible brassiere pad 80 is illustrated with a pair of first interlockable discs 84 secured near the perimeter of the pad 80. Specifically, the first interlockable discs 84 are illustrated as a portion of a snap having a stud (an interlockable member) 86 directed inward from the concave surface 82.

In FIG. 6B, a flexible brassiere pad 90 (similar to flexible brassiere pad 30 in FIG. 2A) has a concave or cupped shape with the concave surface (inner surface) 92. The flexible brassiere pad 90 is shown having a variable thickness that is thicker (labeled "t1") near the center and thinner (labeled "t2") near the perimeter edges. In addition, the flexible brassiere pad 90 is illustrated with a pair of first interlockable discs 94 secured near the perimeter of the pad 90. Specifically, the first interlockable discs 94 are illustrated as a portion of a snap having a stud (an interlockable member) 96 directed inward from the concave surface 92.

Figure 7:
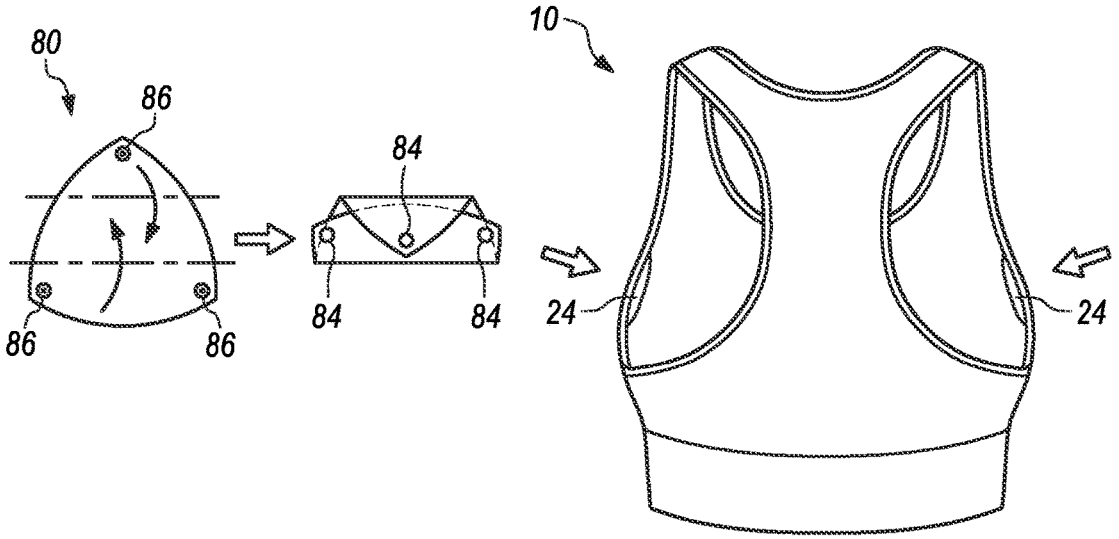
FIG. 7 is a diagram of a flexible brassiere pad being folded and inserted into a pocket of the sports brassiere.

FIG. 7 is a diagram of the flexible brassiere pad 80 being folded and inserted into a pocket of the sports brassiere 10 through the opening 24. While not specifically illustrated, a second flexible brassiere pad 80 may be folded and inserted into a second pocket of the sports brassiere 10 through a second opening 24.

Figure 8:
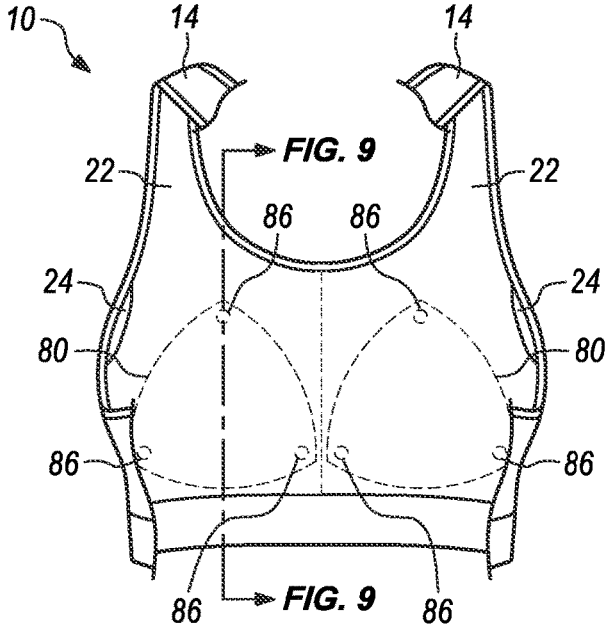
FIG. 8 is a diagram showing the inside of the front panels of the sports brassiere.

FIG. 8 is a diagram showing the inside of the front panels of the sports brassiere 10. The inner fabric layer 22 and the front fabric layer (see front 16 in FIG. 1A) form the pocket of the sports brassiere 10. With the flexible brassiere pads 80 received within the pockets through the openings 24 as shown in FIG. 7, the flexible brassiere pads 80 (shown in dashed lines) are unfolded and positioned as desired by the person to wear the sports brassiere 10. As shown, the flexible brassiere pads 80 are spread across a central area of the cups of the sports brassiere 10 with the inner surface 82 (see FIG. 9) and studs 86 directed against the inner fabric layer 22 (out of the page as illustrated in FIG. 8).

Figure 9:
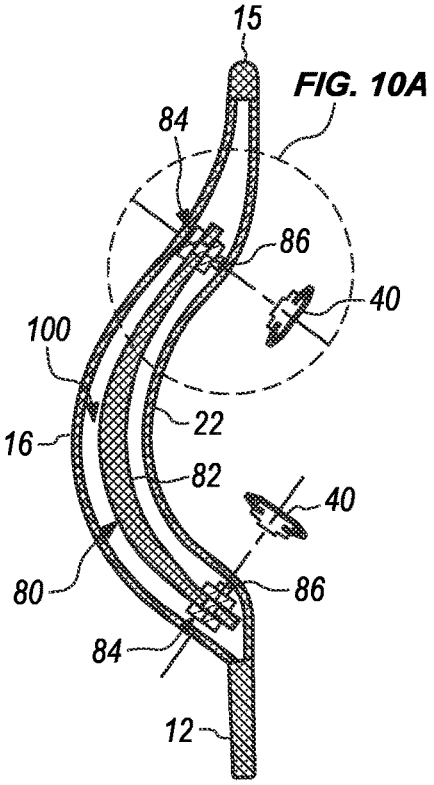
FIG. 9 is a cross-sectional side view of a flexible brassiere pad loosely positioned inside the pocket of the sports brassiere

FIG. 9 is a cross-sectional side view of the flexible brassiere pad 80 taken along the line shown in FIG. 8. The flexible brassiere pad 80 is loosely positioned inside the pocket 100 of the sports brassiere 10, wherein the pocket 100 is formed between the outer fabric layer 16 and the inner fabric layer 22 below the collar 15 and above the band 12. With the inner surface 82 and studs 86 directed toward or against the inner fabric layer 22, a pair of second interlockable discs, such as discs 40 in FIG. 2A, are positioned with a socket axially aligned with the studs 86. In this position, pressing the first and second interlockable discs together with a small manual force will cause the stud 86 in the first interlockable disc 84 (which is secured to the flexible brassiere pad 80) to be received into the socket in the second interlockable disc 40. Despite the presence of the inner fabric layer 22, the stud and socket form a connection that traps the inner fabric layer there between. This connection then prevents the flexible brassiere pad 80 from moving around within the pocket 100 during physical activity, washing and/or drying.

Figure 10A:
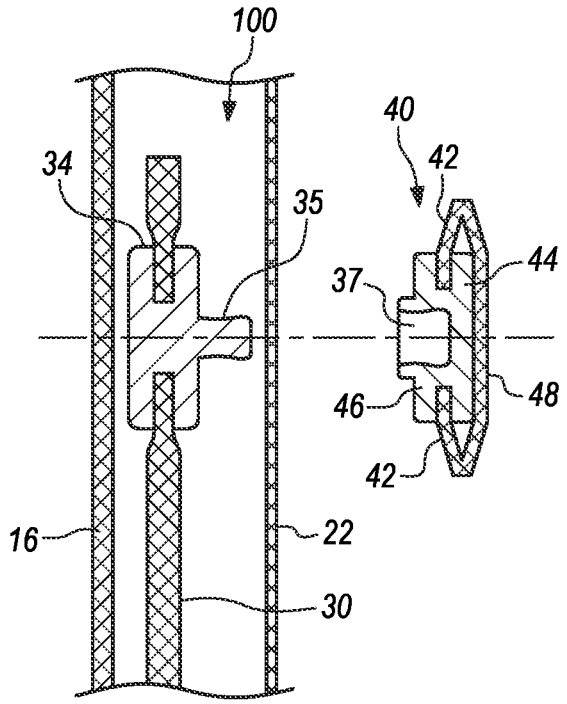
FIGS. 10A-10B are cross-sectional side views of a flexible brassiere pad having a first interlockable disc for connecting to a second interlockable disc with an inner layer of a brassiere breast cup received between the first and second interlockable discs.
Figure 10B:
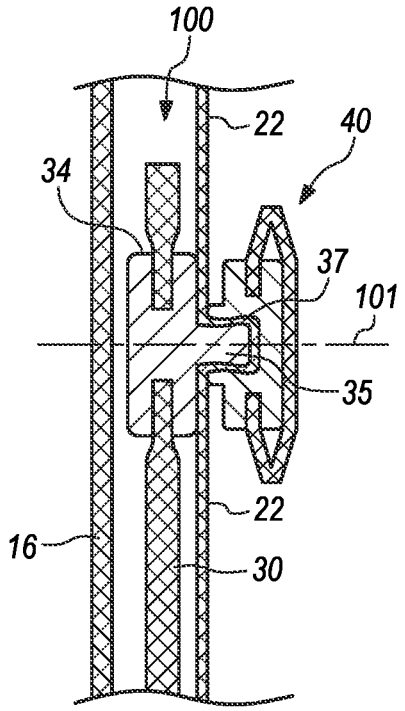

FIGS. 10A-10B are cross-sectional side views of a flexible brassiere pad 30 having a first interlockable disc 34 for connecting to a second interlockable disc 40 with an inner fabric layer 22 of a brassiere breast cup 16 received between the first and second interlockable discs. In FIG. 10A, the flexible brassiere pad 30 is positioned within the pocket 100 and the first interlockable disc 34 has its interlockable member (i.e., the stud 35) directed inward against the inner fabric layer 22. The second interlockable disc 40 is positioned with its interlockable member (i.e., socket 37) axially aligned with the other interlockable member (i.e., stud 35). Furthermore, the second interlockable disc 40 secures a first fabric piece 42 between a backing member 44 and a second member 46 that includes the socket 37. The backing member 44 is covered with a second fabric piece 48 that is sewn to the first fabric piece 42 along a perimeter edge of the first and second fabric pieces. Alternatively, the first and second fabric pieces may form a single fabric piece that is folded over the backing member so that the edges are secured between the backing member 44 and the second member 46.

FIG. 10B shows the connection formed by pressing the first and second interlockable discs 34, 40 together along the axis until the stud 35 has been securely seated within the socket 37 with the inner fabric layer 22 held between the stud 35 and socket 37. Friction, and perhaps compression, retain the stud 35, socket 37 and inner fabric layer 22 in this relationship unless and until the second interlockable disc 40 is removed by applying a manual force away from the first interlockable disc 34 in the generally opposite direction along the axis 101.

Figure 11A:
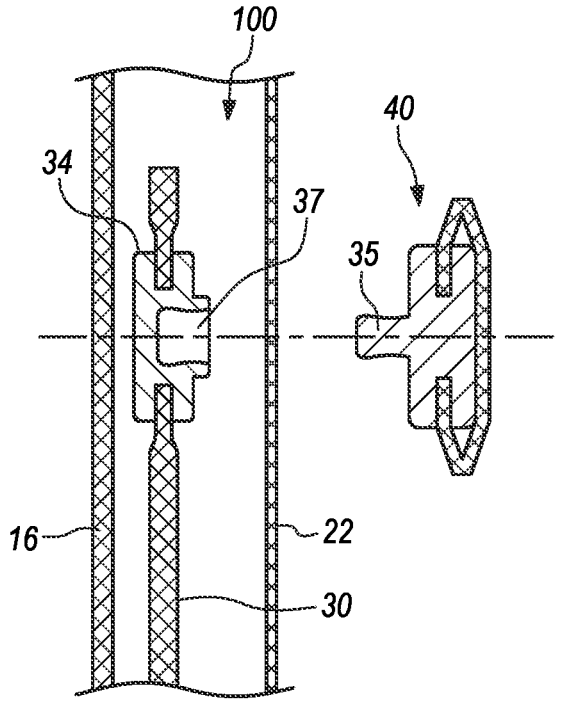
FIGS. 11A-11B are cross-sectional side views of a flexible brassiere pad having a first interlockable disc for connecting to a second interlockable disc with an inner layer of a brassiere breast cup received between the first and second interlockable discs.
Figure 11B:
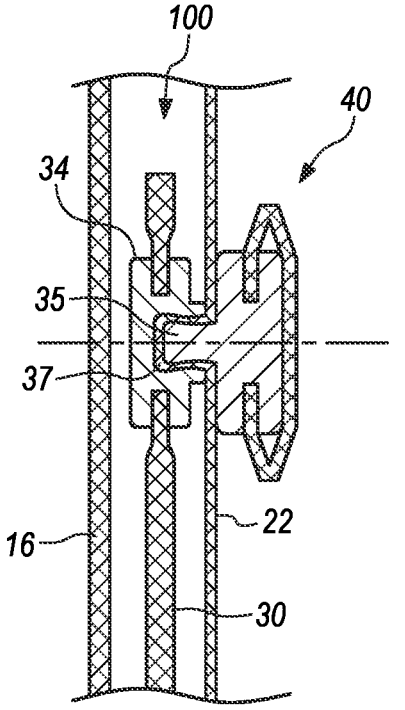

FIGS. 11A-11B are cross-sectional side views of the flexible brassiere pad 30 having a first interlockable disc 34 for connecting to a second interlockable disc 40 with an inner fabric layer 22 of a sports brassiere received between the first and second interlockable discs 34, 40. The primary difference between the apparatus in FIGS. 11A-11B and the apparatus in FIGS. 10A-10B is that the first interlockable disc 34 includes a socket 37 (rather than the stud 35) and the second interlockable disc 40 include a stud 35 (rather than the socket 37). It should be understood that the first and second interlockable discs 34, 40 may be connected in the same manner regardless of which type of interlockable member (i.e., stud or socket) is included in the first interlockable disc secured to the flexible brassiere pad 30. However, the second interlockable disc should have an interlockable member that will form a disconnectable connection with the interlockable member of the first interlockable disc. In other words, one of the interlockable discs may include a stud and a corresponding interlockable disc may include a socket.

Figure 12:
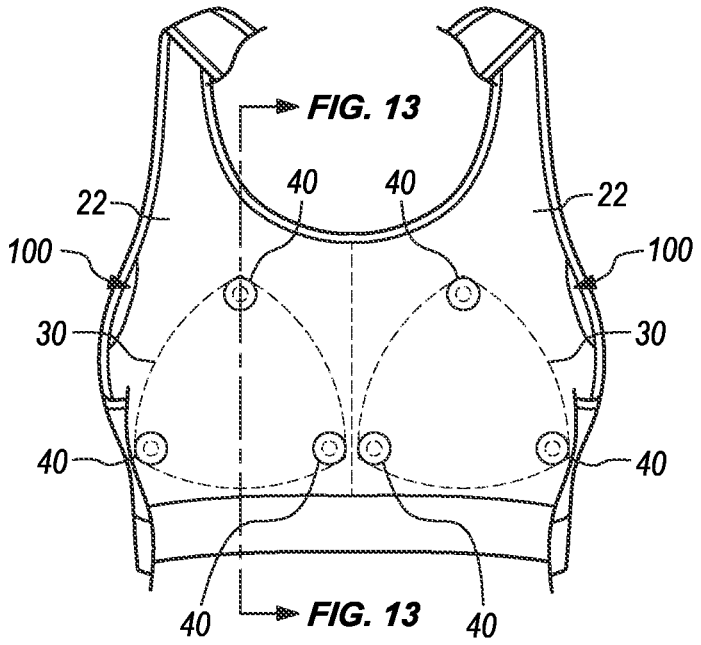
FIG. 12 is a diagram showing the inside of the front panels of the sports brassiere with the second interlockable discs securing the flexible brassiere pads in position within the pocket.

FIG. 12 is a diagram showing the inside of the front panels of the sports brassiere 10 with the second interlockable discs 40 securing the flexible brassiere pads 30 (shown in dashed lines) in position within the pocket 100. The second interlockable discs 40 are directed toward the person and are easily accessible to manually connect and manually disconnect from the first interlockable discs 34 (not shown).

Figure 13:
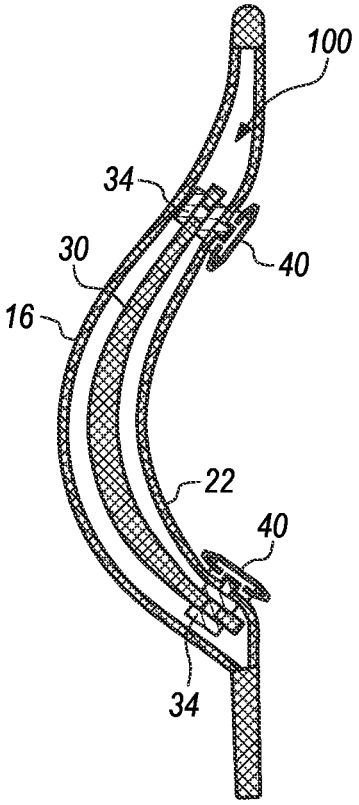
FIG. 13 is a cross-sectional side view of the flexible brassiere pad secured in position within the pocket of the sports brassiere using the first and second interlockable discs.

FIG. 13 is a cross-sectional side view of the flexible brassiere pad 30 secured in a desired position within the pocket 100 of the sports brassiere 10 using the first and second interlockable discs 34, 40. The cross-sectional side view is taken along the line shown in FIG. 12. In actual use, the inner fabric layer 22, the flexible brassiere pad 30, and the outer fabric layer 16 may be pressed against each other as the outer fabric layer 16 presses against the wearer's breasts.

Figure 14:
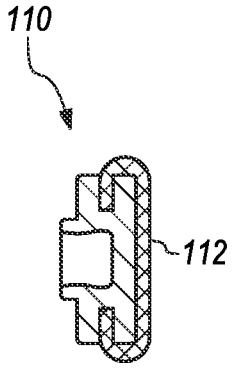
FIG. 14 is a cross-sectional side view of an alternative embodiment of a second interlockable disc.

FIG. 14 is a cross-sectional side view of an alternative embodiment of a second interlockable disc 110. The second interlockable disc 110 has a fabric or foam member 112 that covers the back of the disc 110 that may directly contact the skin.

Figure 15:
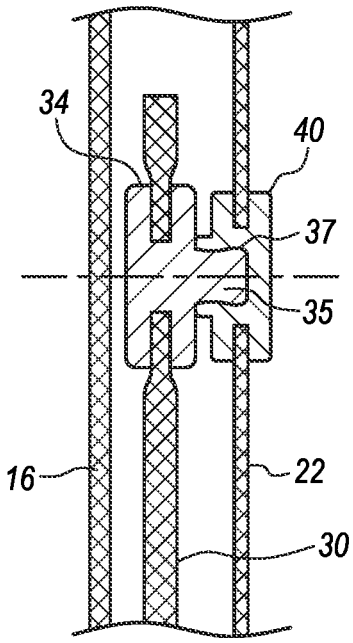
FIG. 15 is a cross-sectional side view of a flexible brassiere pad having a first interlockable disc for connecting to a second interlockable disc that is secured to an inner layer of a brassiere breast cup.

FIG. 15 is a cross-sectional side view of a flexible brassiere pad 30 having a first interlockable disc 34 for connecting to a second interlockable disc 40 that is secured to the inner fabric layer 22 of the sports brassiere. In this embodiment, the first and second interlockable discs 34, 40 may be disconnectably connected to secure the flexible brassiere pad 30 in place without the inner fabric layer 22 being received between the first and second interlockable discs 34, 40. This embodiment may assist a person to consistently position the flexible brassiere pad within the pocket and may prevent any loss of the second interlockable discs. However, the wearer does not get to choose the position or size of the flexible brassier pad.

The terminology used herein is for the purpose of describing particular embodiments only and is not intended to limit the scope of the claims. As used herein, the term "about" may be used synonymously with "approximately" to mean that an amount is not exact and that some variation is contemplated, perhaps due to measurement error or unintentional variations in the concentration of sourced components. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. An apparatus, comprising:

a flexible brassiere pad having a first side;

a plurality of first interlockable discs secured to the flexible brassiere pad, wherein each of the first interlockable discs has a first interlockable member located on the first side of the flexible brassiere pad, and wherein each first interlockable disc includes a first backing member having a set of prongs that extend through the flexible brassiere pad to engage and secure to a second member that includes the first interlockable member; and a plurality of second interlockable discs, wherein each of the second interlockable discs has a second interlockable member that is disconnectably connectable to the first interlockable member of one of the first interlockable discs, and wherein each second interlockable disc includes a first backing member having a set of prongs that extend through a first fabric piece to engage and secure to a second member that includes the second interlockable member.

2. The apparatus of claim 1, wherein the first and second interlockable discs are metal and/or plastic.

3. The apparatus of claim 1, wherein each of the first interlockable discs includes a stud and each of the second interlockable discs includes a socket.

4. The apparatus of claim 1, wherein each of the first interlockable discs includes a socket and each of the second interlockable discs includes a stud.

5. The apparatus of claim 1, wherein the first and second interlockable discs include at least one permanent magnet to cause a magnetic attraction between the first and second interlockable discs.

6. The apparatus of claim 1, further comprising:

a sports brassiere forming a pair of breast cups, each breast cup forming a pocket between an outer fabric layer and an inner fabric layer, wherein the pocket is configured to receive the flexible brassiere pad.

7. The apparatus of claim 6, wherein the first side of the flexible brassiere pad is concave.

8. The apparatus of claim 6, wherein the flexible brassiere pad is received in the pocket with the first side of the flexible brassiere pad directed against the inner fabric layer.

9. The apparatus of claim 6, wherein the inner fabric layer includes a polyether-polyurea copolymer.

10. The apparatus of claim 1, wherein a second fabric piece covers a second side of the second interlockable disc and is secured to the first fabric piece by a thread stitching together a perimeter edge of the first and second fabric pieces.

11. The apparatus of claim 1, wherein the flexible brassiere pad has a perimeter edge, and wherein the plurality of first interlockable discs are secured to the flexible brassiere pad near the perimeter edge of the flexible brassiere pad.

12. The apparatus of claim 11, wherein the perimeter edge of the flexible brassiere pad forms a rounded triangular shape having three vertices, and wherein the plurality of first interlockable discs includes three of the first interlockable discs secured to the flexible brassiere pad near the perimeter edge of the flexible brassiere pad, and wherein, for each of the first interlockable discs, the interlockable disc is positioned proximate a separate one of the vertices.

13. An apparatus, comprising:

a flexible brassiere pad having a first side;

a plurality of first interlockable discs secured to the flexible brassiere pad, wherein each of the first interlockable discs has a first interlockable member located on the first side of the flexible brassiere pad;

a plurality of second interlockable discs, wherein each of the second interlockable discs has a second interlockable member that is disconnectably connectable to the first interlockable member of one of the first interlockable discs; and a sports brassiere forming a pair of breast cups, each breast cup forming a pocket between an outer fabric layer and an inner fabric layer, wherein the pocket is configured to receive the flexible brassiere pad, and wherein, for each of the plurality of second interlockable discs, the second interlockable disc is disconnectably connected to one of the first interlockable discs with the inner fabric layer disposed between the first interlockable disc and the second interlockable disc.

14. The apparatus of claim 13, wherein, for each of the plurality of second interlockable discs, the second interlockable member is formed on a first side of the second interlockable disc and a fabric or foam material covers a second side of the second interlockable disc that is opposite the first side of the second interlockable disc.

15. The apparatus of claim 13, wherein, for each of the plurality of second interlockable discs, the second interlockable member is formed on a first side of the second interlockable disc and a second side of the second interlockable disc has a smooth surface.

16. The apparatus of claim 13, wherein the flexible brassiere pad is held in a fixed position within the pocket by the connections between the plurality of first interlockable discs and the plurality of second interlockable discs.

17. The apparatus of claim 16, wherein each connection between a first interlockable disc of the plurality of first interlockable discs and a second interlockable disc of the plurality of second interlockable discs remain connected in the absence of a user manually disconnecting the second interlockable disc.

18. The apparatus of claim 16, wherein each connection between a first interlockable disc of the plurality of first interlockable discs and a second interlockable disc of the plurality of second interlockable discs remain connected in the absence of a user manually disconnecting the second interlockable disc.

19. The apparatus of claim 13, wherein, for each of the plurality of second interlockable discs, the second interlockable member is formed on a first side of the second interlockable disc and a fabric or foam material covers a second side of the second interlockable disc that is opposite the first side of the second interlockable disc.

20. The apparatus of claim 13, wherein, for each of the plurality of second interlockable discs, the second interlockable member is formed on a first side of the second interlockable disc and a second side of the second interlockable disc has a smooth surface.

21. The apparatus of claim 13, wherein the flexible brassiere pad is held in a fixed position within the pocket by the connections between the plurality of first interlockable discs and the plurality of second interlockable discs.

22. An apparatus, comprising:

a flexible brassiere pad having a first side;

a plurality of first interlockable discs secured to the flexible brassiere pad, wherein each of the first interlockable discs has a first interlockable member located on the first side of the flexible brassiere pad;

a plurality of second interlockable discs, wherein each of the second interlockable discs has a second interlockable member that is disconnectably connectable to the first interlockable member of one of the first interlockable discs; and a garment forming a pair of breast cups, each breast cup forming a pocket between an outer fabric layer and an inner fabric layer, wherein the pocket is configured to receive the flexible brassiere pad, wherein, for each of the plurality of second interlockable discs, the second interlockable disc is disconnectably connectable to one of the first interlockable discs with the inner fabric layer disposed between the first interlockable disc and the second interlockable disc, and wherein the first and second interlockable discs form a fastener selected from a mechanical snap and a magnetic snap.

23. The apparatus of claim 22, wherein each first interlockable disc includes a first backing member having a post that extends through the flexible brassiere pad to engage and secure to a second member that includes the first interlockable member, and wherein each second interlockable disc includes a second backing member having a post that extends through a first fabric piece to engage and secure to a second member that includes the second interlockable member.

* * * * *